US011512697B2

(12) United States Patent
Maurischat et al.

(10) Patent No.: US 11,512,697 B2
(45) Date of Patent: Nov. 29, 2022

(54) METHOD FOR DETERMINING A FLOW VOLUME OF A FLUID DELIVERED BY A PUMP

(71) Applicant: LEISTRITZ PUMPEN GMBH, Nuremberg (DE)

(72) Inventors: Roland Maurischat, Nuremberg (DE); Oliver Trossmann, Oberasbach (DE); Philipp Rossow, Rosstal (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 16/874,770

(22) Filed: May 15, 2020

(65) Prior Publication Data

US 2020/0362839 A1 Nov. 19, 2020

(30) Foreign Application Priority Data

May 15, 2019 (DE) ..... 10 2019 112 792.0

(51) Int. Cl.
*F04C 14/28* (2006.01)

(52) U.S. Cl.
CPC ..... *F04C 14/28* (2013.01); *F04B 2201/0803* (2013.01); *F04B 2201/0808* (2013.01); *F04B 2201/1201* (2013.01); *F04B 2205/07* (2013.01); *F04B 2205/09* (2013.01); *F04C 2270/20* (2013.01); *F04C 2270/21* (2013.01); *F04C 2270/40* (2013.01)

(58) Field of Classification Search
CPC .. F04C 14/28; F04C 2270/21; F04C 2270/20; F04C 2270/40; F04B 2201/0803; F04B 2205/09; F04B 2201/0808; F04B 2201/1201; F04B 2205/07; F04B 49/106
See application file for complete search history.

(56) References Cited

U.S. PATENT DOCUMENTS 5,267,441 A 12/1993 Devier
5,332,366 A * 7/1994 Anderson ..... F04B 15/02 417/53
6,485,465 B2 * 11/2002 Moberg ..... A61M 5/1456 417/18
9,017,040 B2 4/2015 Birch
(Continued)

FOREIGN PATENT DOCUMENTS

DE 102009017887 A1 10/2010
DE 102009028440 A1 2/2011
(Continued)

OTHER PUBLICATIONS

European Search Report, dated Oct. 13, 2020, 2 Pages.
(Continued)

*Primary Examiner* — Bryan M Lettman
(74) *Attorney, Agent, or Firm* — Lucas & Mercanti, LLP; Klaus P. Stoffel

(57) ABSTRACT

A method for determining a flow volume of a fluid delivered by a pump. The flow volume is determined as a function of predefined pump information depending on a pump geometry, rotation speed information, which correlates with the rotation speed of the pump, and pressure information, which correlates with a differential pressure at the pump.

15 Claims, 2 Drawing Sheets

(56) References Cited

U.S. PATENT DOCUMENTS

| | | | | |
|---|---|---|---|---|
| 2007/0212229 | A1* | 9/2007 | Stavale | F04D 15/0209 417/42 |
| 2011/0200450 | A1* | 8/2011 | Shelley | F04B 37/14 417/1 |
| 2013/0251540 | A1 | 9/2013 | Paulus | |
| 2016/0377070 | A1* | 12/2016 | Andersen | F04F 13/00 92/86 |
| 2018/0258926 | A1 | 9/2018 | Jackle | |
| 2018/0259382 | A1* | 9/2018 | Leblay | E21B 21/08 |
| 2018/0291889 | A1* | 10/2018 | Farr | F04B 49/065 |
| 2020/0032788 | A1* | 1/2020 | Mosli | F04B 53/10 |

FOREIGN PATENT DOCUMENTS

| | | | |
|---|---|---|---|
| DE | 102011086572 | A1 | 5/2012 |
| DE | 102017205777 | A1 | 10/2018 |

OTHER PUBLICATIONS

Indian Patent Office issued an Office Action dated Jul. 13, 2021 regarding the parallel Indian Patent Application No. 202014019065, 8 pages.

"Experimental studies on the volumetric efficiency of triple screw pumps." In: International VDI Conference (Sep. 24, 2014), 15 pages.

Chinese Patent Office issued Office Action dated Mar. 2, 2022 regarding parallel Chinese Patent Application No. 202010409503.X, 4 Pages.

Condition Monitoring and Fault Diagnosis of Hydraulic Gear Pump Based on Volumetric Efficiency, Wu Wenfeng, Feb. 2007, pp. 224-226.

* cited by examiner

METHOD FOR DETERMINING A FLOW VOLUME OF A FLUID DELIVERED BY A PUMP

CROSS-REFERENCE TO RELATED APPLICATIONS

The present application claims priority of DE 10 2019 112 792.0, filed May 15, 2019, the priority of this application is hereby claimed and this application is incorporated herein by reference.

BACKGROUND OF THE INVENTION

The invention relates to a method for determining a flow volume of a fluid delivered by a pump. In addition, the invention relates to a pump for delivering a fluid.

Pumps, in particular positive-displacement pumps, are used in a large number of fields of application in which a flow volume delivered by the pump is intended to be monitored or controlled. To this end, a volumetric flowmeter disposed in the feed line or discharge line of the pump can be utilized. However, this can increase the complexity and the occupation of installation space by the pump, and, according to the type of volumetric flowmeter which is utilized, can in some circumstances reduce the efficiency of the pump.

SUMMARY OF THE INVENTION

The object of the invention is thus to define an improved method for determining a flow volume through a pump.

The object is achieved according to the invention by a method for determining a flow volume of a fluid delivered by a pump, in which the flow volume is determined as a function of predefined pump information, which is dependent on a pump geometry, rotation speed information, which correlates with the rotation speed of the pump, and pressure information, which correlates with a differential pressure at the pump.

According to the invention, it is thus proposed to determine a flow volume directly from operating parameters of the pump and from information relating to a known pump geometry. In this context, it is known per se that positive-displacement pumps, for instance screw pumps, per work cycle, i.e., for instance, per revolution, would deliver a specific fluid volume if no internal gaps were present. The disregard of internal gaps and thus of a fluid backflow counter to the delivery direction within the pump leads in many applications, however, to unacceptably high errors. Within the scope of the invention, it has been detected that, as a result of the additional regard to the pressure information, the flow volume can be determined with considerably improved accuracy, whereby a separate determination of the flow volume by a separate volumetric flowmeter can be dispensed with in a large part of the applications.

As will be explained later in still closer detail, it is herein possible to model the influence of the pump geometry on the leakage, and thus on the flow volume, with a small number of parameters. The flow volume can thus be determined with low calculating complexity and hence, for instance, on an anyway present control mechanism of the pump. Moreover, the relevant pump information of a pump can be determined with relatively little effort, for instance within the manufacturing or quality control process.

The pump information can describe a theoretical delivery volume of the pump per revolution of the pump, or can enable the determination of this theoretical delivery volume. Additionally or alternatively, the pump information can comprise at least one piece of information which influences the volumetric efficiency of the pump, thus in particular information relating to gap sizes or to a leakage due to gaps in the pump. The pump information can be provided, for instance, by the manufacturer and can comprise information which accrues anyway within the designing or production of the pump. Additionally or alternatively, the pump information or some of the pump information can be determined by calibration measurements on the pump.

The rotation speed can be determined, for instance, by a rotation speed sensor or rotation angle sensor in the pump or in a drive mechanism of the pump. In many applications, the rotation speed of the pump is anyway actively controlled or regulated by a control mechanism of the pump. In these cases, a desired rotation speed, which can be directly evaluated as rotation speed information, is known anyway. It is also possible to register vibrations of pump components and to deduce therefrom the rotation speed, or the like. In some applications, the rotation speed can also be assumed to be constant.

The pressure information can in particular be determined by one or more pressure sensors, which can be part of the pump or of a fluid circuit driven by the pump. The differential pressure can indicate a pressure difference between the fluid outlet and the fluid inlet of the pump. In the case of rising differential pressure, the leakage increases and the delivery rate, given same rotation speed of the pump, falls. According to the application, it can also be possible to assume the differential pressure at the pump to be constant.

At least one variable on which the flow volume depends is determined within the method, in particular using sensors belonging to the pump or external sensors. The at least one determined variable can be the rotation speed information and/or the pressure information, though further operating parameters, for instance fluid characteristics, a fluid temperature or the like, can be determined by sensors.

The further comments assume, by way of example, that a positive-displacement pump, in particular a screw pump, is used as the pump. As the screw pump, a triple screw pump can preferably be used, though, alternatively, also a double screw pump. The following comments can, however, also transfer to other pumps, in particular other positive-displacement pumps.

In the following statements, it is assumed, moreover, that the fluid, at the differential pressure arising at the pump, can be roughly described as incompressible. If the compressibility is disregarded, in a large number of applications sufficient accuracies of the flow volume definition can be achieved. Through disregard of the compressibility, the method according to the invention can be implemented with low calculating complexity, and thus readily on standard control mechanisms of pumps, for instance microcontrollers. Moreover, the necessary pump information can be determined relatively easily. It is also possible, however, in the relevant calculation steps, to additionally take the compressibility into account, which, in particular in the case of a very high differential pressure at the pump, or if gases are delivered, can lead to an increased accuracy of the determined flow volume.

The flow volume can be calculated by subtracting a leakage volume flow determined as a function of the pressure information from a theoretical delivery volume flow determined as a function of a pump volume predefined by the pump information and the rotation speed information. In other words, in the method according to the invention, the leakage volume flow can be used as a correction of the volumetric delivery rate theoretically achieved on the basis of the pump volume and the rotation speed. The leakage volume flow can in particular additionally depend on the pump volume and/or a gap geometry, wherein relevant parameters can be provided as part of the pump information. Preferably, in the determination of the leakage volume flow, at least one fluid information relating to the delivered fluid, in particular the viscosity and/or density thereof, is taken into account.

In the method according to the invention, as additional information, a temperature and/or a viscosity and/or a density of the fluid, and/or an operating current and/or a shaft torque of the pump, can be registered, wherein the flow volume and/or the leakage volume flow are determined as a function of the additional information. The determination of said variables or at least of some of said variables can be realized by a sensor system belonging to the pump and/or a sensor system external to the pump.

The leakage volume flow can in particular depend on the viscosity and density of the fluid. Through a semiempirical dimension analysis, the following relationship can be given for the leakage volume flow $Q_L$:

$$Q_L^+ = a\cdot(\Delta p^+\cdot\Psi^3)^b,\ \text{with}\ \Delta p^+ = \frac{\Delta p}{V^2\rho V^{-2/3}}\ \text{and}\ Q_L^+ = \frac{Q_L}{\nu V^{1/3}} \tag{1}$$

In this, the variables $Q_L^+$ and $\Delta p^+$ are dimensionless variables which are assigned to the leakage volume flow $Q_L$ and to the differential pressure $\Delta_p$ at the pump. Moreover, these variables depend on the kinematic viscosity v and the density p of the fluid and on the pump volume V. Through the utilization of dimensionless variables, equation (1) describes the correlation between a specific leakage volume flow $Q_L^+$ and a specific differential pressure $\Delta p^+$, which correlation is independent of the viscosity and density of the fluid and the pump volume. This means that this correlation, as soon as corresponding parameters a, b and Ψ have been found, applies independently of viscosity and density of the fluid and pump volume. A once found equation (1) can thus be utilized for various fluids and, to a certain degree, also for various pumps.

The parameters a, b and Ψ can herein be defined by calibrating measurements on the pump to be utilized. This will be explained later in still closer detail.

For some of the abovementioned additional information, it can be advantageous to not register these directly by sensors, since an appropriate sensor system can be relatively complex. Instead, they can be determined using other operating parameters which are easier to register. In particular, where a known fluid is utilized, the density and/or viscosity of the fluid can be predefined on a temperature-dependent basis, for instance in the form of a look-up table or of a known mathematical correlation. This enables, for instance instead of a complex viscometer, a temperature registration which is relatively easy to implement and which is frequently provided anyway in fluid circuits.

A shaft torque can be registered directly, for instance, via a torque sensor. Alternatively, it is also possible to regard the shaft torque as a motor torque of a drive motor. If an electric motor is utilized, the motor torque can be determined, for instance, as a function of the supplied current or the supplied power and the rotation speed.

If shaft torques have been defined, then also a viscosity of the fluid can be determined herefrom. If the compressibility of the fluid, and thus the compression work, is disregarded, for the shaft torque $M_S$ the following relationship applies:

$$M_s \approx \frac{\Delta pV}{2\pi} + M_{mh} \tag{2}$$

The first therm herein describes the torque contribution which is required for the delivery of the fluid, and the second therm $M_{mh}$ describes the mechanical and hydraulic losses. However, according to the relationship $$M_{mh} = R_{\Delta p}\Delta pV + R_V\frac{V\rho nV}{\Psi} + R_\rho\rho n^2V^{5/3}, \tag{3}$$

these depend on the kinematic viscosity v. The prefactors R can be defined by calibrating measurements or theoretical considerations or the like. n is the rotation speed of the pump or of the shaft. The further variables have already previously been introduced. If the other parameters are known, the viscosity v can thus be calculated from the shaft torque $M_S$.

At least one pressure sensor, and/or at least one force sensor which registers a force acting on a pump component, in particular on a bearing, can be used to determine the pressure information. In particular, two pressure sensors can be utilized, of which one measures a pressure in a line which feeds fluid to the pump, and one measures pressure in a line which leads fluid away from the pump. From these two pressures, the differential pressure at the pump, and thus the pressure information, can be determined by subtraction. Alternatively, a differential pressure sensor, which is fluidically coupled with a volume before and after the pump in order to directly determine the pressure difference, can be utilized. In particular in screw pumps, a differential pressure at the pump produces, moreover, a force on the individual screws. The pressure information can thus also be determined by measuring a force on a bearing of one of these screws.

By a vibration sensor, a vibration of at least one component of the pump can be registered, wherein the rotation speed information is determined in dependence on sensor data of the vibration sensor. Already minor imbalances of rotated parts, for instance screws, of a pump lead to vibrations, which have heavily pronounced frequency components at at least an integer multiple of the rotation speed. In the case of screw pumps, vibration maxima typically occur at a frequency which corresponds to double the rotation speed. Corresponding frequencies can be detected, for instance, in that a vibration signal, in particular after a digitalization, is processed in order to detect corresponding frequency components. For instance, an interval between respectively two breaches of a limit value can be detected by the signal, strong frequency components can be detected by an autocorrelation, or a Fourier transformation of the signal can be performed. The advantage of utilizing a vibration sensor is that, for this purpose, no intervention has to be made in the pump mechanism, since corresponding vibrations can be picked up on almost every component, for instance on the pump casing.

The pump information preferably describes a pump volume which indicates a theoretical delivery volume per revolution of the pump. By the theoretical delivery volume per revolution should be understood that volume which would be transported upon one revolution of the pump if no internal leakages were to occur in the pump, i.e. all gaps of the pump were absolutely fluidtight. The pump volume or the theoretical delivery volume can be determined from a known geometry of the pump, which is defined, for instance, within the pump design or which is determined on the basis of the measurement of pump components. Alternatively, it can be possible within the method, or in a prepared step, to define the geometric pump volume from the actual delivery rate. For instance, a series of measurements can be performed with various differential pressures at the pump. Since the loss falls with falling differential pressure at the pump, the series of measurements can be extrapolated up to a differential pressure of 0, whereby the actually measured delivery volume approximates to the theoretical delivery volume.

For the calculation of the flow volume or of the leakage volume flow, several approaches are possible. In the simplest case, calibrating measurements can be performed for a specific pump or for a specific group of similar pumps, wherein respectively the flow volume or the leakage volume flow is measured for a multiplicity of parameter sets. For instance, measurements can be performed for different differential pressures and rotation speeds. The resulting measurement values can be utilized to implement a multidimensional look-up table, so that, from specific currently available parameters, respectively the flow volume or the leakage volume flow can be read out from this table or determined by interpolation from this table. Alternatively, on the basis of the measurement values, a mathematical correlation can also be determined, for instance by regression analysis, which correlation can then be utilized to determine the flow volume or leakage volume flow from the parameters.

In principle, it is also possible to utilize these measurement data to train a machine learning process, for instance a neural network. The training can be realized, for instance, by a Back Propagation of Error, that is to say that the neural network can be trained such that it determines, with the parameters as input data with highest possible accuracy, the corresponding flow volume or leakage volume flows. Appropriate machine learning methods are generally known in the prior art and shall not be explained in detail.

The described approaches can respectively be performed for a single pump or a family of pumps. Through the utilization of additional parameters, for instance of a pump type or of the pump volume, a common look-up-table or a common mathematical correlation or a common method trained by machine learning can however also be utilized to determine flow volume or leakage volume flows for different pumps or pump types.

The hitherto explained methods require that the entire parameter space of the input parameters, from which the flow volume or the leakage volume flow is intended to be determined, is scanned in order to determine initial measurement data. In particular, if a relatively large number of input parameters are intended to be used and, for instance, a multiplicity of pumps or pump types are intended to be jointly characterized, very complex series of measurements are thus necessary. In order to avoid this, various approaches are conceivable.

For instance, a physical model of the pump, in which the respective pump is modeled as a hydraulic circuit diagram, can be constructed. In this case, the arising gaps can be assigned to various gap types. Typically, it is sufficient to distinguish between about 10 different gap types, which can be described in part analytically and in part semianalytically. The parameters of the model can be determined by an exact measurement of the actual pump. Alternatively, it is also possible to purposefully modify individual gaps in order to determine their influence on the flow volume or the leakage volume flow. The physical modeling of pumps, and some categories of gap, are described, for instance, in the publication Corneli, T.; Preuß, N.; Troßmann, O.; Pelz, P. F.: "Experimental studies on the volumetric efficiency of triple screw pumps." In: International VDI Conference "Screw Machines 2014", Sep. 23-24, 2014, Dortmund.

Particularly preferredly, in the method according to the invention there is utilized, however, an equivalence model, which reduces the relatively complex structure of a pump to just a few parameters which are to be taken into account. Such an equivalence model can be determined, in particular, by a dimension analysis, wherein, by an appropriate choice of model, the parameters of the fluid, i.e., in particular the viscosity v and the density p, as well as the pump volume V, can be separated from further model parameters which are to be determined empirically. Such an equivalence model has already been given above as equation (1). As parameters which can potentially depend on the pump geometry, there remain in the herein the parameters a, b, Ψ and V.

In the method according to the invention, it is thus possible that, for the determination of the flow volume and/or of the leakage volume flow, the pump geometry is described by a maximum of four parameters. In other words, the flow volume or the leakage volume flow is determined in dependence on a maximum of four parameters relating to the pump geometry. In this case, one of the parameters can describe the pump volume or the theoretical delivery volume per revolution of the pump, while the other parameters are preferably dimensionless variables independent of this volume. In the above equation, these are the parameters a, b and Ψ. The number of parameters can be further reduced by defining the parameter a' as follows:

$$a' = a \cdot \Psi^{3b} \tag{4}$$

Thus the specific leakage volume flow $Q_L^+$ depends solely on the specific differential pressure $\Delta p^+$ and the parameters a' and b. The parameters a' and b can be defined within calibrating measurements, in that the specific leakage volume flow $Q_L^+$ is plotted double-logarithmically against the specific differential pressure $\Delta p^+$. Aside from measurement errors, the measurement values should all lie on a straight line, wherein the parameter b corresponds to the gradient of this straight line and the parameter a' corresponds to the Y-intercept.

Within preliminary trials, it was detected that, for different pumps of the same type, yet surprisingly also for pumps of different type, for instance for piston pumps, eccentric screw pumps, triple screw pumps, gear pumps and double screw pumps, the same parameter b, for instance 0.7, can be used. The pump geometry can thus even be described just by two parameters, namely the pump volume V and the parameter a', wherein a' depends in particular on the gaps present in the pump. The splitting of the variable a' into the variables a and Ψ in the original equation enables Ψ to be defined as a relative gap size, wherein, for a selected pump, Ψ=1 can be set and the variable a can be chosen accordingly. The description of the gap geometry can thus be realized solely by the parameter Ψ.

At least one of the parameters describing the pump geometry can be defined by evaluating measurement data of at least two calibrating measurements which are performed on the pump at mutually different differential pressure. In particular, in accordance with the pump volume, precisely two calibrating measurements can be performed in order to determine the parameters set out above. This is in particular easily possible in double-logarithmic representation due to the above-discussed linear correlation between the specific leakage volume flow and the specific differential pressure.

As a function of the rotation speed information and/or the pressure information and/or the additional information and/or the leakage volume flow and/or the flow volume, in particular as a function of the temporal progression of the rotation speed information and/or the pressure information and/or the additional information and/or the leakage volume flow and/or the flow volume, wear information, which indicates whether wear on the pump reaches or exceeds a predefined limit value and/or which indicates a severity of the wear and/or which describes a change in the pump geometry or in the pump information due to the wear, can be determined. Thus, within the method according to the invention, wear on the pump can easily be detected in order to promptly detect, for instance, an advisable changing of the pump. Alternatively or additionally, the wear information can be taken into account in order to correct a determination of the flow as a function of the wear information and, in the process, modify, in particular, the pump information.

In the simplest case, the actual flow volume or the actual leakage volume flow can be measured and compared with a value determined for this purpose within the method according to the invention. Large variances can point to wear on the pump. In particular, such a measurement can be performed for different differential pressures, in order to, as set out above, correct or redefine at least one parameter describing the pump geometry.

Preferably, the wear information should be determined, however, without a direct measurement being made of the flow volume or of the leakage volume flow. To this end, in the simplest case a determined flow volume or a determined leakage volume flow could be compared with a limit value or at least one previously determined value in order to detect a lowering of the flow volume or a rise in the leakage volume flow under otherwise same conditions. The above-discussed particularly simple approaches to defining the flow volume do not, however, initially take into account a change in pump geometry due to wear, so that these approaches are not suitable for detecting wear in this way.

In order to be able to detect wear also with said simple approaches to the determination of flow volume, other indications of wear can be evaluated. To this end, in particular a current value or a temporal progression of the shaft torque $M_S$ can be evaluated. As already set out above with respect to equation (2), the shaft torque comprises a mechanically-hydraulic loss torque $M_{mh}$, which has already been given as equation (3). Wearing of the pump can in particular have two consequences. Wear on bearings can increase a friction in bearings of the pump and thus, in particular, alter the parameter $R_{\Delta p}$. An enlargement of gaps due to wear and tear, or a clogging of gaps by contaminants leads to a variation of the gap size $\Psi$. If the shaft torque thus markedly changes while the parameters otherwise remain the same, then this points to wear on the pump. In order to detect this, for one specific or for a plurality of parameter sets at which the pump can be operated, a respective limit value can, for instance, be specified, wherein if the respective limit value is exceeded or fallen below by the shaft torque, an incidence of wear is indicated. In order to avoid false detections, with respect to the shaft torque a mean value or a median value for a registration period comprising a plurality of shaft torque registrations can be considered. A comparison with corresponding limit values can be viewed as a reference check.

Alternatively, the temporal progression of the shaft torque, given otherwise same operating parameters of the pump or taking into account the changes in the further operating parameters of the pump, can be considered in order to perform a trend check. For instance, a rise in the shaft torque and a drop in the shaft torque over a lengthy period, given otherwise same operating conditions, can point to wear.

In order to be able to distinguish between the various types of wear or in order to determine a corrected pump information, in particular a corrected parameter $\Psi$, a measurement of the shaft torque at different rotation speeds and given otherwise same operating parameters of the pump can be performed. As can be deduced from equation (3), the various therms of the mechanically hydraulic loss torques are dependent on various powers of the rotation speed n. For instance, through a regression analysis of the measurement data recorded at different rotation speeds, a contribution of the shaft torque that is independent from the rotation speed, a contribution of the shaft torque that is linearly dependent on the rotation speed, and a proportion of the shaft torque that is quadratically dependent on the rotation speed, can thus be determined. From that proportion of the torque $M_{mh}$ that is linearly dependent on the rotation speed, the gap size $\Psi$ can be directly calculated using the further known parameters.

The wear information can potentially also be determined independently of the flow volume. Thus the invention also relates quite generally to a method for determining wear information which relates to wear on a pump and which, as a function of rotation speed information correlated with the rotation speed of the pump and/or a pressure information correlated with a differential pressure at the pump and/or at least one of the abovementioned additional pieces of information, or depends on a temporal progression of these variables. The method can be refined as set out above.

In addition, the invention relates to a pump for delivering a fluid, which pump is designed to implement the method according to the invention for determining a flow volume, wherein it comprises at least one sensor device, which is designed to register the rotation speed information and/or the pressure information and/or the additional information, and a processing device, which is designed to determine the flow volume in dependence on at least the pump information, the rotation speed information and the pressure information. Additionally or alternatively, the pump can be designed to implement the method for defining the wear information. The processing device can in particular be designed to control or to regulate the pump, in particular its rotation speed. The processing device can thus also be referred to as the control mechanism. The pump is preferably a positive-displacement pump, specifically a screw pump.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
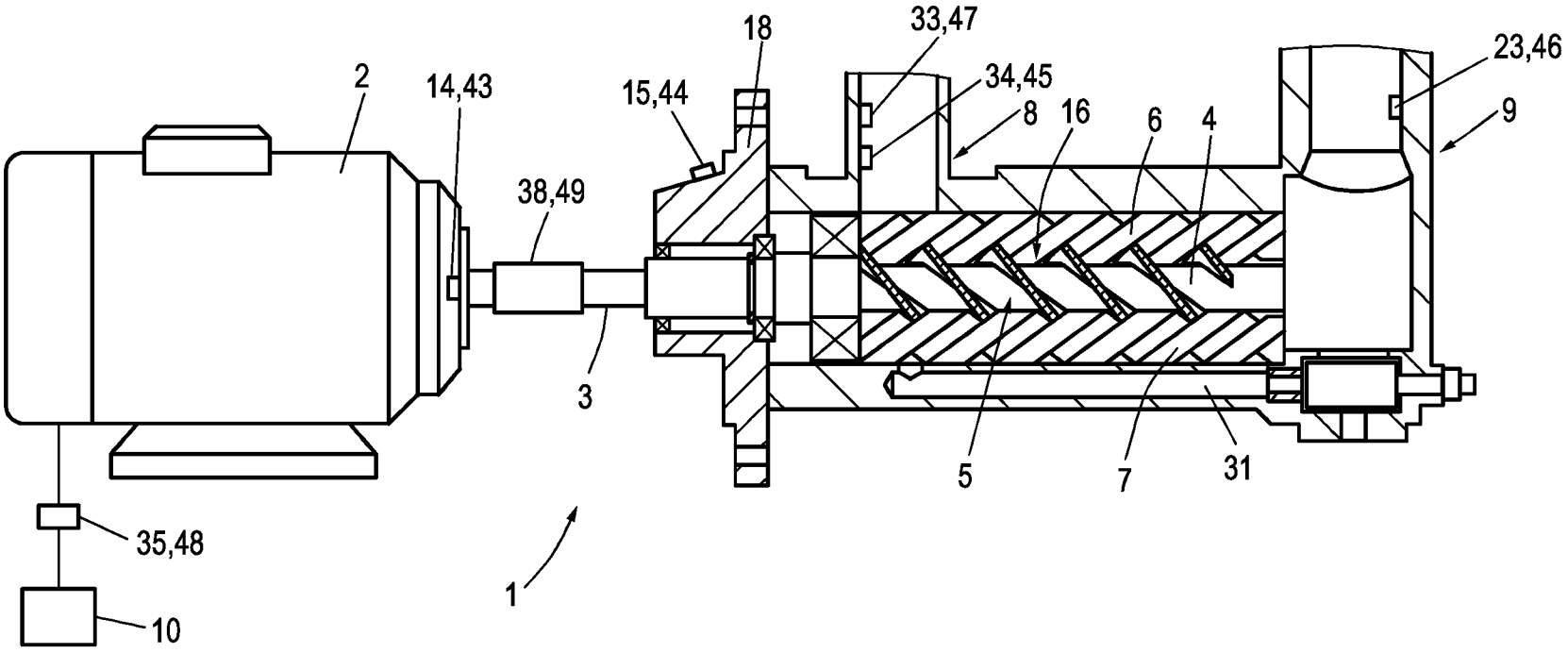
FIG. 1 shows an illustrative embodiment of a pump according to the invention.

FIG. 1 shows a pump 1, in the example a screw pump. This comprises a motor 2, which, via a shaft 3, drives a main screw 4. The main screw 4 is also referred to as the drive screw. This is arranged adjacent to the secondary screws 6, 7, which are also referred to as running screws, so that, in a resulting interspace 5 which is jointly formed by the main screw 4 and the secondary screws 6, 7, upon rotation of the shaft 3, fluid is delivered from the fluid inlet 8 to the fluid outlet 9. Operating parameters of the pump 1 are registered by a plurality of sensor devices 43 to 49. Screw pumps are well known in the prior art and shall therefore not be explained in detail.

Figure 2:
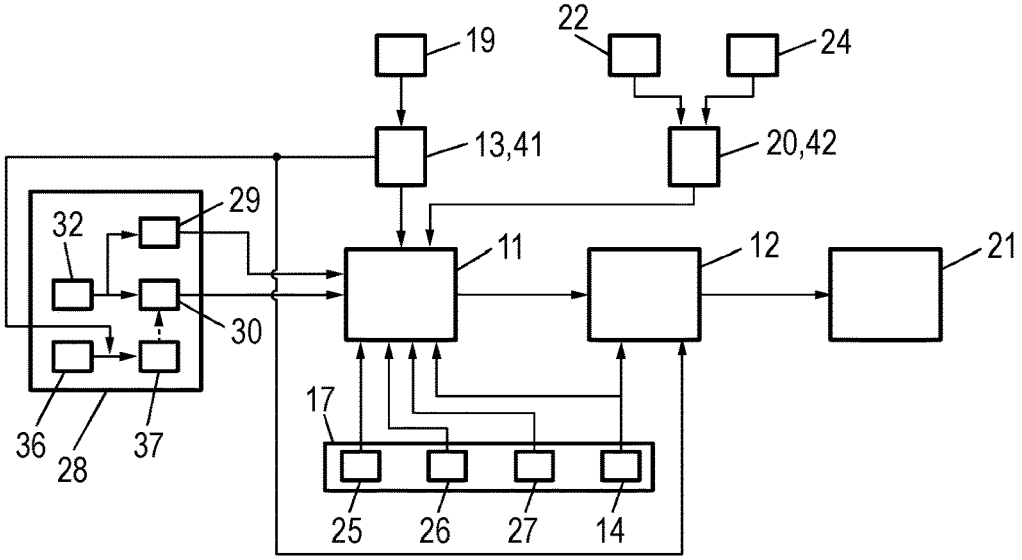
FIG. 2 shows the information processing in an illustrative embodiment of the method according to the invention.

In many applications, a flow volume delivered from the fluid inlet 8 to the fluid outlet 9 is intended to be determined. Options for this are set out below with additional reference to FIG. 2. In principle, it would be possible to completely disregard a leakage volume flow 11, i.e. a backflow of fluid through gaps 16 in the pump 1. In this case, a theoretical delivery volume flow 12 could be directly determined as the flow volume, by multiplying a predefined pump volume 14 or a theoretical delivery volume per revolution of the pump by rotation speed information 41 describing the rotation speed 13. The geometric pump volume 14, of which account is taken as the pump information 17 or part of this pump information 17, can be directly determined by the parameters of the pump design. For instance, it can be determined as a function of the screw diameter, the screw pitch and of predefined geometry factors. It is herein also possible to measure in detail the concrete shape of the screws or of the casing 18 in order to more accurately define the volume. Alternatively, a cycle of measurements can be performed, for instance, at various pressures falling at the pump 1, and a theoretical delivery volume per revolution can hereby be extracted from the actual flow volume.

The rotation speed 13 can anyway be known if the processing device 10 controls the motor 2 such that a predefined rotation speed is set. It is also possible for the rotation speed to be registered directly by a rotation speed sensor 14. In some embodiments, it can also be advantageous to determine the rotation speed by registering, via a vibration sensor 15, sensor data 19 relating to a vibration of a component of the pump 1, for instance the casing 18. The vibrations or sensor data 19 typically have a strong frequency contribution at at least an integer multiple of the rotation speed 13, in particular at double the rotation speed 13. By analyzing the frequencies arising in the sensor data 19, the rotation speed 13 can thus likewise be defined.

The theoretical delivery volume flow 12 is typically, however, heavily flawed. By additionally taking into account the differential pressure 20 at the pump 1, a flow volume 21 can be calculated with considerably improved accuracy. In particular, the leakage volume flow 11 is calculated as a function of the differential pressure 20 or of pressure information 42 describing this differential pressure 20, and subtracted from the theoretical delivery volume flow 12 in order to define the flow volume 21. The differential pressure 20 can be determined by an inflow-side pressure sensor 33 determining a first pressure value 22 and an outflow-side pressure sensor 23 determining a second pressure value 24, wherein the pressure values 22, 24 are subtracted one from the other in order to calculate the differential pressure 20. Alternatively, a differential pressure sensor could, for instance, be utilized to directly determine the differential pressure.

As already explained with reference to equation (1), the leakage volume flow 11 can depend on up to three further parameters 25, 26, 27, for instance the above-discussed parameters a, b and Ψ, which are provided as part of the pump information 17. As will be explained later in still closer detail, these can be determined by calibrating measurements on the pump 1 or on further pumps.

As additional information 28, in particular a density 29 and a viscosity 30 of the delivered fluid can be taken into account. The density 29 and the viscosity 30 could be determined, for instance, via special measuring devices, which can be disposed in a bypass duct 31. Where an always substantially same fluid is used at substantially always same temperature, these variables can also be assumed and predefined to be constant.

In particular, if a direct determination of the density 29 or viscosity 30 is intended to be dispensed with, it can be advantageous to additionally register the temperature 32 of the fluid via a temperature sensor 33. This temperature can in particular be evaluated to define, with the aid of a look-up table or a known mathematical correlation, a temperature-dependent viscosity 30 and/or density 29 of the respective fluid.

Moreover, it can be advantageous to monitor, by a current sensor 35, a current 36 supplied to the motor 2 or a power supplied to the motor 2. Jointly with the rotation speed 13, a torque 37 at the shaft 3 can be calculated herefrom. Alternatively, this torque 37 could be registered by a torque sensor 38. As will further be explained later with reference to FIG. 4, a registration of the torque can in particular be advantageous in order to be able to detect wear on the pump 1 or in order to adapt at least one of the parameters 25, 26, 27 to take account of a corresponding wear situation. Moreover, as has already been explained with reference to the equations (2) and (3), an evaluation of the shaft torque 37 can be utilized to define the viscosity 30, or at least to detect changes in the viscosity 30.

Figure 3:
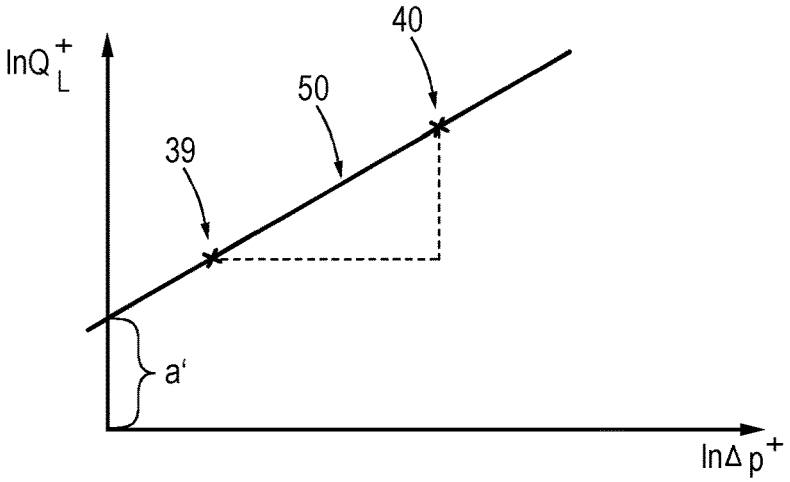
FIG. 3 shows the determination of parameters relating to a pump geometry in the method explained with reference to FIG. 2.

If, as set out above, the parameters 25, 26, 27 are chosen such that they correspond to the variables a, b and Ψ explained with reference to equation (1), then these parameters, or at least parts of these parameters, are determined by calibrating measurements on the pump. This is represented below, by way of example, in FIG. 3. If the relationship $$a' = a \cdot \Psi^{3b} \tag{4}$$

in equation (1) is used, then it is evident that, in the double-logarithmic plotting, shown in FIG. 3, of the specific leakage volume flow against the specific differential pressure, the measuring points of all calibrating measurements 39, 40 should lie on a straight line 50. The Y-intercept herein corresponds to the parameter a', and the parameter b corresponds to the gradient of the straight line 50. It can thus already be sufficient to determine two specific leakage volume flows $Q_L^+$ at various specific differential pressures $\Delta p^+$ in order to determine the parameters a' and b. As already explained with reference to equation (1), these parameters would already be sufficient to describe the correlation between leakage volume flow and differential pressure at the pump 1. The splitting of the parameter a' into the parameters a and Ψ can be advantageous, since the parameter Ψ can be chosen, by appropriate choice of the parameter a, such that it can intuitively be construed as a measure of a gap.

Figure 4:
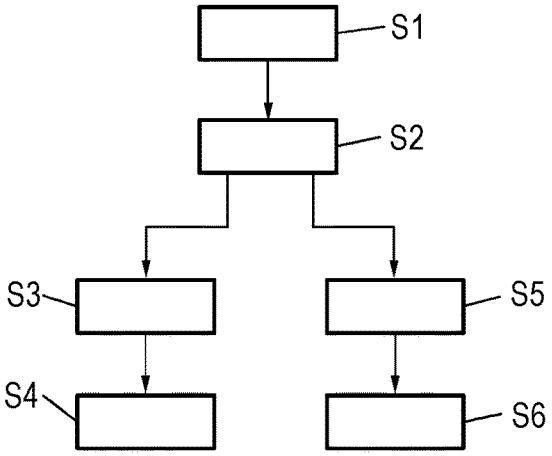
FIG. 4 shows a flow chart for determining a wear variable in an illustrative embodiment of the method according to the invention.

FIG. 4 shows a flow chart of a method for determining wear on the pump 1. This can be considered as part of the previously described method for determining a flow volume, yet can also be utilized separately herefrom. For the detection of wear, use is made of the fact that a mechanically hydraulic loss torque $M_{mh}$, as already set out above, can be represented as follows:

$$M_{mh} = R_{\Delta p}\Delta pV + R_V\frac{V\rho nV}{\Psi} + R_\rho\rho n^2V^{5/3} \tag{3}$$

The three summated loss therms respectively depend on another power of the rotation speed n. In order to make use of this, in step S1 the shaft torques 37 are firstly determined at a plurality of rotation speeds and given otherwise same measurement parameters. The measurements at the individual rotation speeds are herein realized quasi-statically, that is to say a rotation speed is firstly set and is maintained at least until such time as the shaft torque 37 has stabilized. Contributions to the increase in or reduction of the rotation speed are thus not taken into account.

In step S2, an analysis of the measurement data registered in step S1 is performed, wherein, in particular, a fit or a regression is performed in order to distinguish between contributions to the shaft torque 37 which are not dependent on the rotation speed n, are linearly dependent on the rotation speed n, and are quadratically dependent on the rotation speed n. In the shown illustrative embodiment, in step S3 solely the torque contributions independent of n are taken into account, from which, in step S4, in particular the parameter $R_{\Delta p}$ can be determined or a change in this parameter can be detected. A change in the parameter $R_{\Delta p}$ can in particular indicate that wearing is leading to increased loss of friction in a bearing of the pump 1.

In step S5, by contrast, solely those torque contributions which are linearly dependent on the rotation speed are taken into account. From these, in step S6, under the assumption that $R_v$ is constant, a change in the clearance Ψ, or a concrete value for this variable, can be determined. Thus a change in gap geometry as a result of deposits or as a result of material removal can likewise be detected. In particular, the parameter Ψ determined in this way can be taken into account, as part of the pump information 17, in a subsequent determination of the flow volume 21. Thus it is potentially not only possible to detect the presence of wear in order, for instance, to alert a user to a necessary exchange or necessary maintenance of the pump, but even concrete effects of the wear on the flow measurement can be determined and taken into account.

While specific embodiments of the invention have been shown and described in detail to illustrate the inventive principles, it will be understood that the invention may be embodied otherwise without departing from such principles.

We claim:

1. A method for determining a flow volume of a fluid delivered by a positive-displacement pump, wherein the flow volume is determined as a function of predefined pump information, which is dependent on a pump geometry, a rotation speed information, which correlates with the rotation speed of the pump, and pressure information, which correlates with a differential pressure at the pump, wherein, as additional information, an operating current and/or a shaft torque of the pump are registered, wherein the flow volume is determined by the function which further comprises the additional information, wherein the flow volume is calculated by subtracting a leakage volume flow, which is determined as a function of the pressure information and a function of the additional information, from a theoretical delivery volume flow, which is determined as a function of a pump volume predefined by the predefined pump information and the rotation speed information.

2. The method according to claim 1, wherein, as further additional information, a temperature and/or a density of the fluid are registered, wherein the flow volume is determined by the function which further comprises the further additional information.

3. The method according to claim 1, wherein at least one pressure sensor, and/or at least one force sensor which registers a force acting on a pump component are used to determine the pressure information.

4. The method according to claim 3, wherein the pressure information is determined by at least one force sensor which measures the force on the pump component which is a bearing.

5. The method according to claim 1, wherein, by a vibration sensor, a vibration of at least one component of the pump is registered, wherein the rotation speed information is determined in dependence on sensor data of the vibration sensor.

6. The method according to claim 1, wherein the pump information describes a pump volume which indicates a theoretical delivery volume per revolution of the pump.

7. The method according to claim 1, wherein, for the determination of the flow volume, the pump geometry is described by a maximum of four parameters.

8. The method according to claim 7, wherein at least one of the parameters describing the pump geometry is defined by evaluating measurement data of at least two calibrating measurements which are performed on the pump at mutually different differential pressures.

9. The method according to claim 1, wherein, as a function of the rotation speed information and/or the pressure information and/or the additional information and/or the flow volume, wear information, which indicates whether wear on the pump reaches or exceeds a predefined limit value and/or which indicates a severity of the wear and/or which describes a change in the pump geometry which the predefined r in the pump information depended on due to the wear, is determined.

10. The method according to claim 9, wherein, as a function of the temporal progression of the rotation speed information and/or the pressure information and/or the additional information and/or the flow volume, wear information, which indicates whether wear on the pump reaches or exceeds a predefined limit value and/or which indicates a severity of the wear and/or which describes a change in the pump geometry which the predefined pump information depended on due to the wear, is determined.

11. A pump for delivering the fluid, wherein it is designed to implement the method according to claim 1, wherein it comprises at least one sensor device, which is designed to register the rotation speed information and/or the pressure information and/or the additional information, and a processing device, which is designed to determine the flow volume in dependence on at least the predefined pump information, the rotation speed information and the pressure information.

12. The method according to claim 1, wherein, as further additional information, a temperature and/or a density of the fluid are registered, wherein the leakage volume is determined by the function which further comprises the further additional information.

13. The method according to claim 1, wherein, for the determination of the flow volume, the pump geometry is described by a maximum of four parameters.

14. The method according to claim 1, wherein, as a function of the leakage volume flow, wear information, which indicates whether wear on the pump reaches or exceeds a predefined limit value and/or which indicates a severity of the wear and/or which describes a change in the pump geometry which the predefined pump information depended on due to the wear, is determined.

15. The method according to claim 14, wherein the wear information is determined as a function of the temporal progression of the leakage volume flow.

* * * * *